United States Patent [19]

De Fazio, Jr.

[11] Patent Number: 4,475,650

[45] Date of Patent: Oct. 9, 1984

[54] CASE FOR DRAFTSMAN

[76] Inventor: Joseph De Fazio, Jr., 216 Nelson Run Rd., Pittsburgh, Pa. 15237

[21] Appl. No.: 511,833

[22] Filed: Jul. 8, 1983

[51] Int. Cl.[3] ..... H45C 11/36; B44D 3/00

[52] U.S. Cl. ..... 206/371; 206/224; 312/231

[58] Field of Search ..... 206/224, 371; 312/231

[56] References Cited

U.S. PATENT DOCUMENTS

| | | | |
|---|---|---|---|
| 1,369,439 | 2/1921 | Johnson | 312/231 |
| 2,632,683 | 3/1953 | Sterling | 312/231 |
| 3,620,362 | 11/1971 | Valdes | 206/224 |
| 4,244,632 | 1/1981 | Molinari | 312/231 |

*Primary Examiner*—William T. Dixson, Jr.
*Attorney, Agent, or Firm*—John W. Linkhauer

[57] ABSTRACT

The invention permits a draftsman or student to carry needed materials conveniently for work at various locations and it also can be used to enable such a person to work at one location without investing the money and the space for a bulky drafting table. There is provided a case which encloses the above-mentioned needed materials and also contains a lid-support mechanism which locks at various positions. One exterior surface of the case is a drawing surface, and the lid-support mechanism permits it to be retained, when in use, at a desired angle with respect to the horizontal.

5 Claims, 7 Drawing Figures

CASE FOR DRAFTSMAN

BACKGROUND OF THE INVENTION

1. Field of the Invention

This invention relates to an article of manufacture which is in the general nature of a briefcase or portfolio but which is specifically suited for carrying and/or storing drafting implements and materials. Moreover, it is particularly useful in that it also provides, as needed, a suitably inclined drafting surface.

2. Description of the Prior Art

It is known, from U.S. Pat. No. 1,720,682, to provide a desk pad which affords a writing or drawing surface and contains compartments "proportioned to take articles commonly used about a desk."

The idea of providing an "attache-type case" which has an exterior surface upon which writing or drawing is done is shown in U.S. Pat. No. 3,980,362.

Perhaps the most pertinent reference is Clark U.S. Pat. No. 1,799,973, "Drafting Case and Board." It discloses a drafting case which is intended to serve some of the same purposes as the present invention. The structure of Clark provides a case which contains a drawing board and a T square. It can be converted from a carrying or storage position to a working position, and vice versa. It differs, however, in several ways from the device of the present invention, as will be explained more fully hereinbelow.

Both the battery-operated pencil-sharpener means which is preferably provided in accordance with the invention and the locking hinge means have hitherto been known per se, but there has not been in the prior art any suggestion that these features be incorporated in an article of the general kind described by Clark.

SUMMARY OF THE INVENTION

The invention permits a draftsman or student to carry needed materials conveniently for work at various locations and it also can be used to enable such a person to work at one location without investing the money and the space for a bulky drafting table. There is provided a case which encloses the above-mentioned needed materials and also contains a lid-support mechanism which locks at various positions. One exterior surface of the case is a drawing surface, and the lid-support mechanism permits it to be retained, when in use, at a desired angle with respect to the horizontal.

DESCRIPTION OF THE DRAWING

A complete understanding of the invention may be obtained from the foregoing and following description thereof, taken in conjunction with the appended drawings, in which.

DESCRIPTION OF THE PREFERRED EMBODIMENTS

Figure 1:
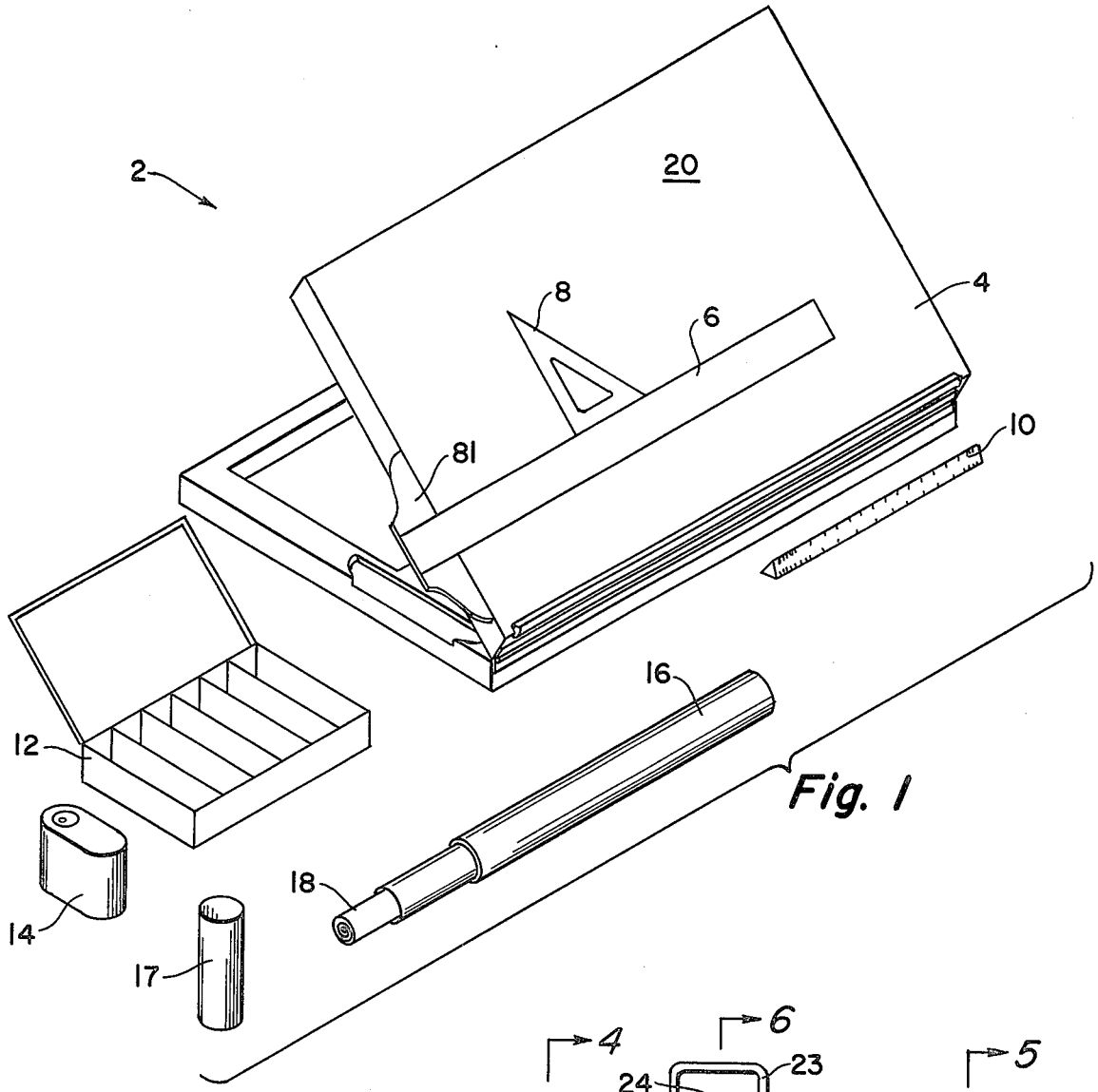
FIG. 1 is an expanded isometric view of a drafting set and its containing case in accordance with the present invention.

There is shown in FIG. 1 a drawing set 2 in accordance with the present invention, including a case 4 therefor, comprising a T square 6, triangle 8, scale 10, pencil box 12, battery-operated electrical pencil sharpener 14, and tube 16 and top 17 therefor for containing drawing paper or drawings 18. A proper drawing set comprises the items indicated above as well as certain other items (not illustrated) which are capable of being fitted within the pencil box 12, such as pencils, erasers, tape, stencils for lettering, etc. Moreover, as will be explained hereinbelow in greater detail, a drawing set 2 and case 4 therefor in accordance with the present invention are characterized in that the drawing surface 20 of the case 4 is capable, because of the use therein of a suitable latching means 22 (see particularly FIG. 6), of being positioned in any desired one of a plurality of angular positions with respect to the horizontal. At the same time the case 4 and drawing set 2 are such that it is possible with their use to meet the criteria and attain the objectives of the invention. They provide a structure of great usefulness, not only as respects providing a drawing set and case which are relatively lightweight and portable but also as respects affording a structure which compactly stores all the things needed for drawing while they are not in use.

Figure 2:
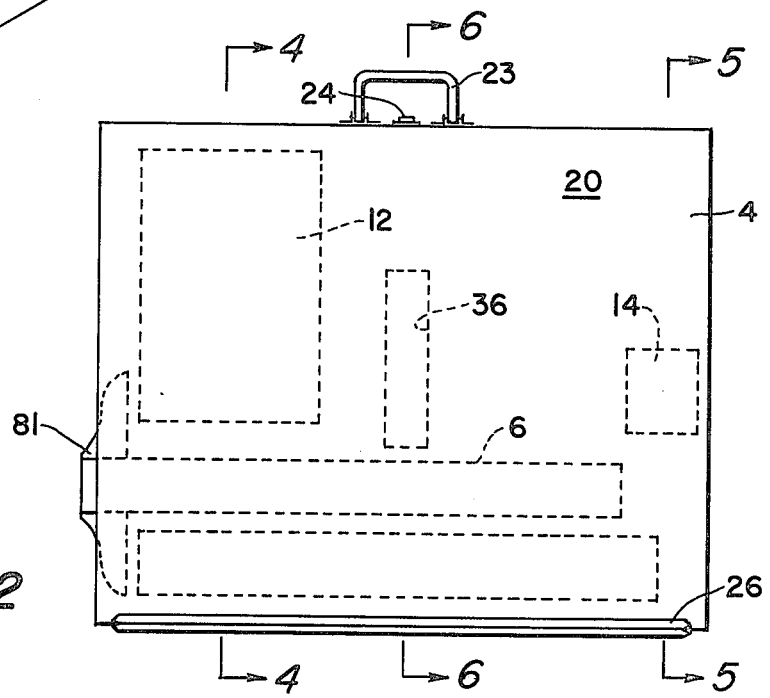
FIG. 2 is a plan view of the drawing set and case therefor in accordance with the invention, certain items being shown in phantom outline.

In FIG. 2, it can be seen that the case 4 is provided with a handle 23 and a clasp 24. Suitably secured or affixed (by means not shown) to the one of the longer edges of the drawing surface 20 which is more remote from the handle 23 and clasp 24, there is preferably provided a ledge and foot means 26.

Figure 3:
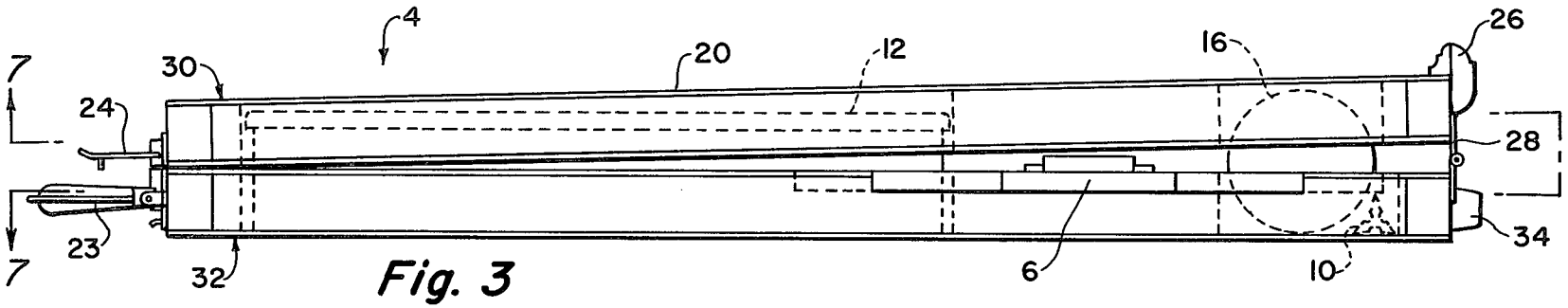
FIG. 3 is a side view of the drawing set and case of the invention.

FIG. 3 is a side view, looking at the case 4 from the side from which the T square 6 protrudes. As there shown, there is a hinge means 28, which serves to join a lid half 30 of the case 4 to a bottom half 32, which is preferably provided with a foot member 34 of such dimensions as to enable the case to be stood upright upon it and the means 26.

Figure 4:
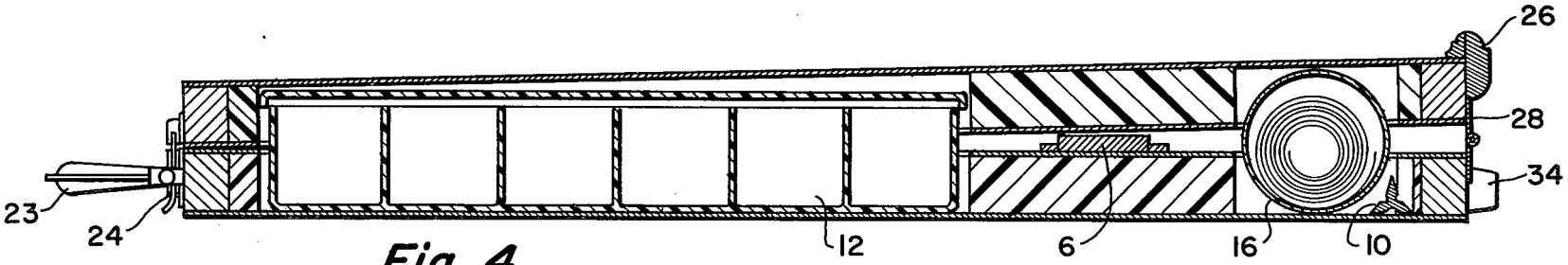
FIG. 4 is a sectional view taken on the line 4—4 of FIG. 2.

In FIG. 4, there is shown a cross-sectional view through the case of the invention, indicating the positioning therein of some of the parts of the drawing set of the invention. Thus, there can be seen the T square 6, scale 10, pencil box 12, and tube 16, as well as the handle 23 and the clasp means 24 in its closed position.

Figure 5:
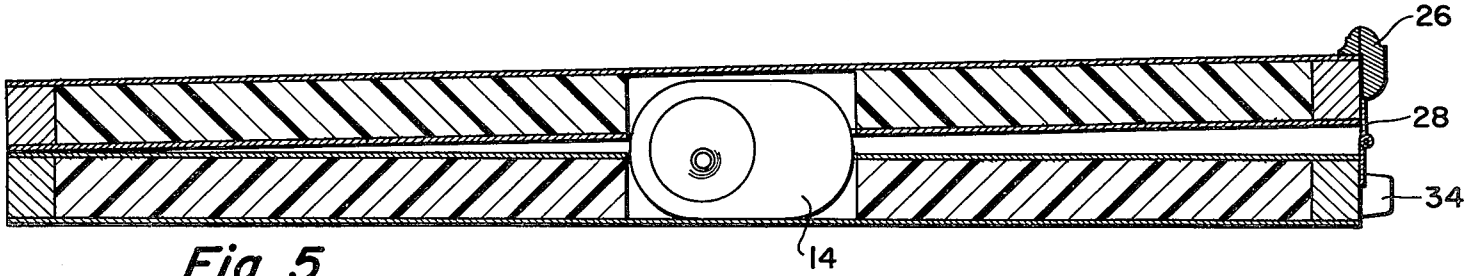
FIG. 5 is a sectional view taken on the line 5—5 of FIG. 2.

FIG. 5 is a similar view at a different location, such that there is shown the enclosing of the battery-operated electrical pencil sharpener means 14.

Figure 6:
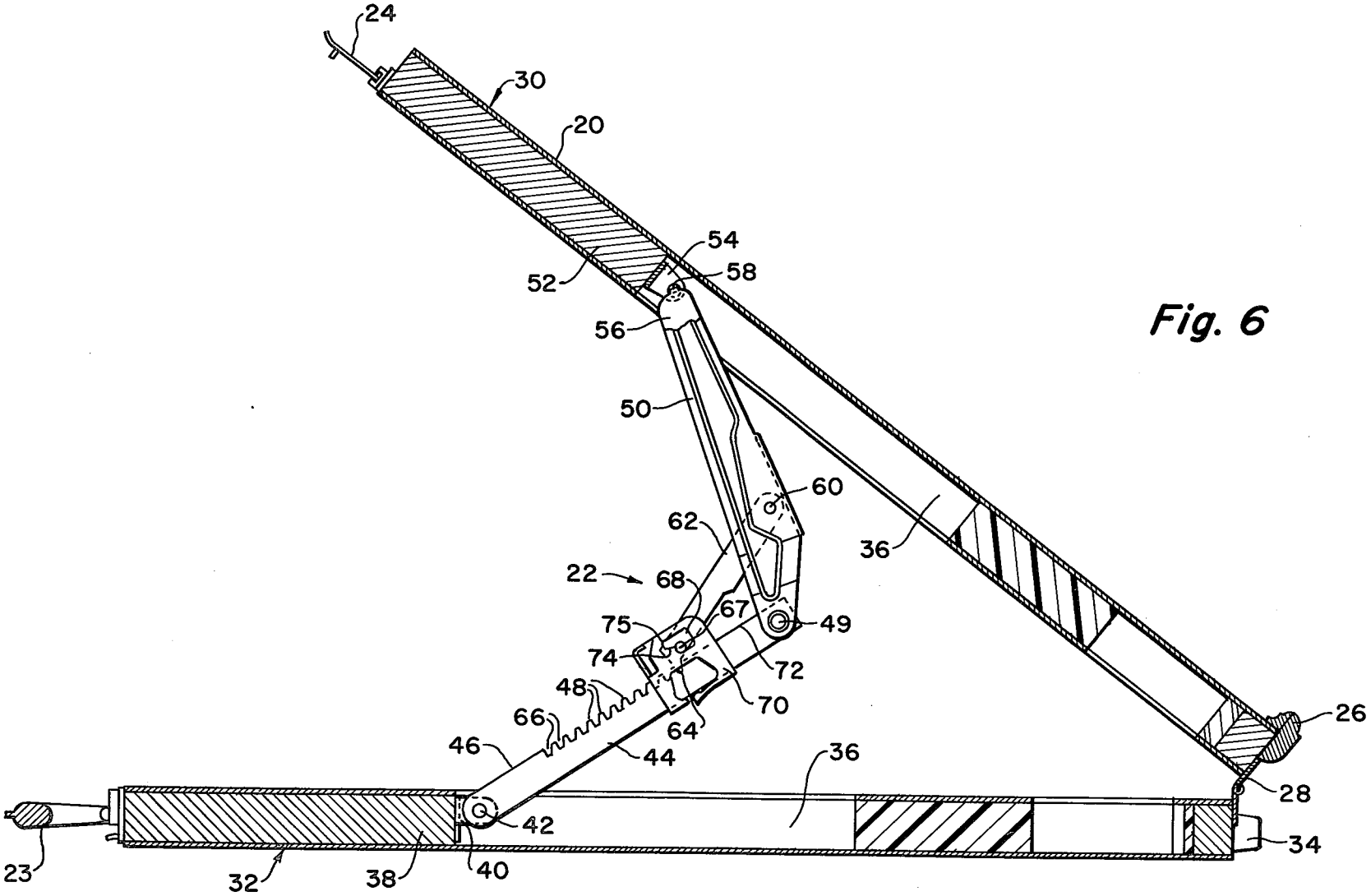
FIG. 6 is a sectional view taken on the line 6—6 of FIG. 2, but modified to show the case in an opened position.

FIG. 6 is a similar cross-sectional view, one which shows in detail one form of a latching means 22 located interiorly of the case, for permitting the lid portion 30 of the case to be retained, while the drawing surface 20 is in use, at a desired one of a plurality of different angular positions with respect to the horizontal.

One form of a suitable latching means 22 may be more particularly described as follows. Both lid portion 30 and the bottom portion 32 of the case 2 have therein hollowed portions which create a cavity 36 within which the latching means 22 is received. Suitably affixed to a block 38 of wood or the like in the bottom portion 32 of the case is a bracket 40 adapted to be connected pivotally as at 42 with a first arm member 44 having in an upper edge 46 thereof a number of teeth 48 for a purpose to be explained more fully hereinbelow; the end of the first arm member 44 has at its end remote from the pivotal connection at 42 a pivotal connection 49 with a second arm member 50. Suitably affixed to a block 52 of wood or the like in the lid portion 30 of the case 4, there is a bracket 54, to which the end 56 of the second arm member 50 remote from the pivotal connection 49 is pivotally and disconnectably joined as at 58. Pivotally connected to the arm member 50, as at 60, there is a finger member 62, the end 64 of which is adapted to become engaged in a desired one of the slots 66 formed by the teeth 48. The finger member 62 has a pin 67 which rides in an opening 68 in a slide member 70 that surrounds the first arm member 44. The shape of the opening 68 in the slide member 70 is such that whenever the lid portion 30 has been so sufficiently raised as to bring the end 64 into contact with the portion 72 of the upper edge 46, then the pin 67 is so located that when the lid portion 30 is lowered, the pin 67 slides along the inclined surface 74 of the opening 68 and into the corner 75 of the opening 68, so that the finger member 62 is kept out of contact with the slots 66 and teeth 48, and this makes it possible to close the case 4.

In operation, as the case 4 is opened, the end 64 of the finger member first slides along the upper edge 46 of the first arm member 44 and then begins to engage the teeth 48, having the possibility of falling by gravity successively into various ones of the slots 66 there between. Releasing the upward pressure upon the lid portion 30 of the case 4 when a desired angular position of the drawing surface 20 has been reached causes the end 64 of the finger member 62 to fall into a slot 66, thereby leaving the drawing surface 20 in the desired angular position with respect to the horizontal. If a steeper position is desired, it is possibly merely to raise the lid portion 30 a suitable amount, thereby causing the end 64 of the finger member 62 to engage a different one of the slots 66.

When it is desired to close the case 4, or to position the drawing surface at a smaller angle with respect to the horizontal, the lid is raised so that the pin and the slide member travel towards the pivotal connection 49 and past the vicinity of the teeth 48, and then as described above the pin 67 is brought into the corner 75 of the opening 68, whereby the end 64 is kept out of engagement with the teeth 48 during the downstroke of the lid portion 30 of the case 4.

Figure 7:
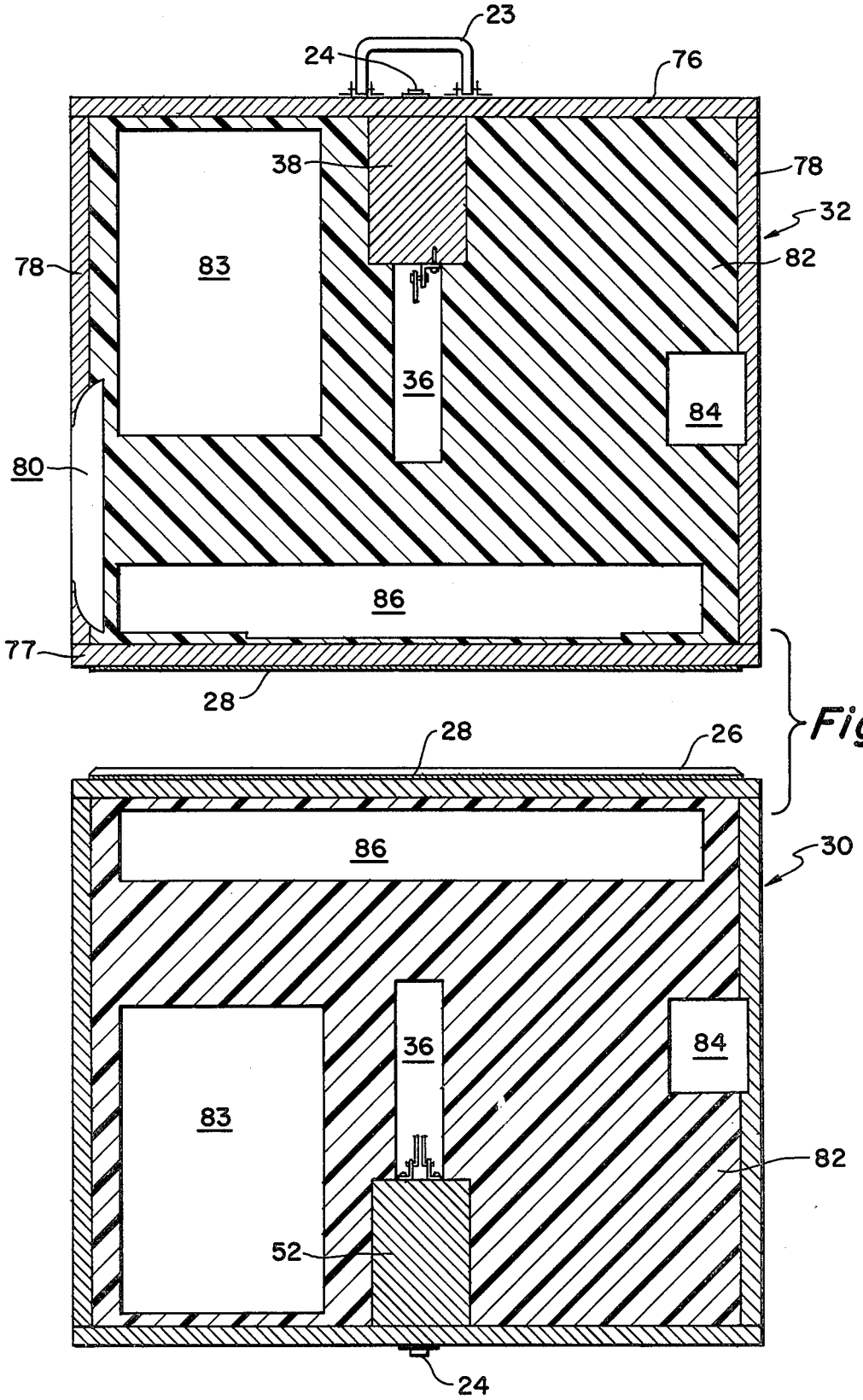
FIG. 7 is a sectional view taken on the line 7—7 of FIG. 3.

In FIG. 7, which is a sectional view taken on the line 7—7 of FIG. 3, there may be seen essentially the appearance of the case 4 of the invention in its fully opened position, with the latching means 22 largely remaining unshown because of the manner in which the section has been taken. In FIG. 7, the bottom half 32 of the case 4 of the invention is at the top of the FIGURE and the lid portion 30 is at the bottom of the FIGURE. The case 4 contains a handle 23 and a clasp means 24 shared by the lid and bottom portions 30 and 32, respectively. The bottom portion has exterior handle, foot and side edges 76, 77 and 78, respectively, which are preferably of wood or other suitable material of construction. In one of the side edges 78, there is provided, as shown, a hollow portion or cavity 80. As is apparent from its shape, it is adapted to receive the portion 81 of the T square 6. The bottom portion is largely filled, except for the space occupied by the block 38, with a member 82 of suitable material such as polystyrene foam or other suitable foamed plastic, the member 82 having therein suitably shaped cavities such as the above-mentioned cavity 36 which accommodates the latching mechanism 22, not to mention also the cavities 83, 84, and 86, which are so dimensioned as to receive, preferably somewhat snugly, respectively, the pencil box 12, the battery-operated electrical pencil-sharpener means 14, and the tube 16 for containing the drawings 18.

In one embodiment of my invention, the case is provided with a suitably shaped protective plastic cover (not shown) which envelopes the case 4, having therein an opening through which the handle 22 protrudes and, in a preferred embodiment, also has on one side thereof a pocket to permit one or more large sheets of drawing paper to be stored flatwise.

While I have shown and described herein one embodiment of my invention, I intend to cover as well any change or modification therein which may be made without departing from its spirit and scope.

I claim as my invention:

1. A case for carrying or storing drafting materials, said case comprising a bottom portion containing a plurality of compartments or portions having therein hollowed spaces so shaped as to receive snugly various implements and supplies useful in drafting including a T square, a lid portion hingedly connected at a first one of its sides to a side of said bottom portion, and latchingly connected on one of its sides opposite to said first one of its sides to a corresponding side of said bottom portion, a handle means, an exterior face of said lid portion being adapted to provide a drawing surface, said case particularly comprising a latching hinge means operatively connected interiorly of said case to said bottom and lid portions and serving to permit said lid portion to be retained while the drawing surface is in use at a desired one of a plurality of different positions with respect to the horizontal.

2. A case as defined in claim 1, characterized in that one of said hollowed spaces is so shaped as to receive snugly a battery-operated pencil-sharpener means.

3. A case as defined in claim 1, wherein said handle means is connected to said bottom portion of said case.

4. A case as defined in claim 3, characterized in that one of said hollowed spaces is so shaped as to receive snugly a battery-operated pencil-sharpener means.

5. As an article of manufacture, a drawing set including implements and a case therefor, said implements including a T square, a pencil box, a battery-operated electrical pencil sharpener, and a tube for containing drawing paper, said case comprising a bottom portion containing a plurality of compartments or portions having therein hollowed spaces so shaped as to receive snugly said implements, a lid portion hingedly connected with first one of its sides to a side of said bottom portion, and latchingly connected on one of its sides opposite to said first one of its sides to a corresponding side of said bottom portion, a handle means, an exterior face of said case being adapted to provide a drawing surface, and said case particularly comprising a latching hinge means operatively connected interiorly of said case to said bottom and lid portions and serving to permit said lid portion to be retained while the drawing surface is in use at a desired one of a plurality of different positions with respect to the horizontal.

* * * * *